US009272553B2

(12) United States Patent
Kyotani

(10) Patent No.: US 9,272,553 B2
(45) Date of Patent: Mar. 1, 2016

(54) RECORDING APPARATUS

(71) Applicant: BROTHER KOGYO KABUSHIKI KAISHA, Nagoya-shi, Aichi-ken (JP)

(72) Inventor: Tadao Kyotani, Nagoya (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 14/667,799

(22) Filed: Mar. 25, 2015

(65) Prior Publication Data

US 2015/0273909 A1 Oct. 1, 2015

(30) Foreign Application Priority Data

Mar. 31, 2014 (JP) ..... 2014-073363

(51) Int. Cl.
*B41J 29/38* (2006.01)
*B41J 2/01* (2006.01)

(52) U.S. Cl.
CPC ... *B41J 29/38* (2013.01); *B41J 2/01* (2013.01)

(58) Field of Classification Search
USPC ..... 347/4–6, 9, 12–14, 16, 17, 19, 20–23, 347/25, 30, 40–44, 47, 68, 84–86, 96–98, 347/104, 105, 110, 197, 198; 400/621, 400/621.1, 621.2, 655
See application file for complete search history.

(56) References Cited

U.S. PATENT DOCUMENTS 5,517,317 A * 5/1996 Kumada ..... G06K 15/102 347/5
6,672,695 B1 * 1/2004 Naka ..... B41J 2/17503 347/19
2004/0021711 A1 * 2/2004 Hasseler ..... B41J 2/175 347/6

FOREIGN PATENT DOCUMENTS

JP 2002-326727 A 11/2002

* cited by examiner

*Primary Examiner* — Kristal Feggins
(74) *Attorney, Agent, or Firm* — Scully, Scott, Murphy & Presser, PC

(57) ABSTRACT

First information indicates that no medium exists in an accommodating device. Second information indicates that a medium exists in the accommodating device. A recording apparatus is configured to take a detectable state and an undetectable state. A processor is configured to: in response to failure in a feeding operation of one medium, perform a retry process of controlling a feeder to again perform the feeding operation; in response to not succeeding in the feeding operation even after the retry process is performed a set number of times of retry, store the first information in the memory; in response to succeeding in the feeding operation, store the second information in the memory; and in response to returning from the undetectable state to the detectable state, perform a first determining process of determining whether a medium exists in the accommodating device based on one of the first and second information.

13 Claims, 4 Drawing Sheets

RECORDING APPARATUS

CROSS REFERENCE TO RELATED APPLICATIONS

This application claims priority from Japanese Patent Application No. 2014-073363 filed Mar. 31, 2014. The entire content of the priority application is incorporated herein by reference.

TECHNICAL FIELD

The invention relates to a recording apparatus.

BACKGROUND

A recording apparatus is known in which an accommodating device is supported by a casing so as to open and close. For example, a copier is disclosed in which a cassette is supported by a main body so as to open and close.

SUMMARY

According to one aspect, the invention provides a recording apparatus. The recording apparatus includes a casing, a recording device, an accommodating device, an open-close sensor, a feeder, a processor, and a memory. The recording device is provided in the casing and configured to perform recording on a recording medium. The accommodating device is supported by the casing and configured to open and close relative to the casing. The accommodating device is configured to accommodate the recording medium. The open-close sensor is configured to output a signal indicative of whether the accommodating device is open or closed. The feeder is configured to perform a feeding operation of feeding the recording medium in the accommodating device to the recording device. The memory is configured to store instructions and to store information indicative of whether a recording medium exists in the accommodating device. The information includes first information indicating that no recording medium exists in the accommodating device and second information indicating that a recording medium exists in the accommodating device. The recording apparatus is configured to take a detectable state and an undetectable state. The detectable state is a state in which the open-close sensor is supplied with electric power so as to enable detection of whether the accommodating device is open or closed. The undetectable state is a state in which the open-close sensor is not supplied with electric power so as to disable detection of whether the accommodating device is open or closed. When executed by the processor, the instructions cause the processor to: in response to failure in the feeding operation of one recording medium, perform a retry process of controlling the feeder to again perform the feeding operation; in response to not succeeding in the feeding operation even after the retry process is performed a set number of times of retry, store the first information in the memory; in response to succeeding in the feeding operation, store the second information in the memory; and in response to returning from the undetectable state to the detectable state, perform a first determining process of determining whether a recording medium exists in the accommodating device based on one of the first information and the second information.

BRIEF DESCRIPTION OF THE DRAWINGS

Embodiments in accordance with the invention will be described in detail with reference to the following figures wherein.

DETAILED DESCRIPTION

Some aspects of the invention will be described while referring to the accompanying drawings.

First, an overall configuration of an inkjet printer 1 according to a first embodiment will be described while referring to FIG. 1 and so on.

Figure 1:
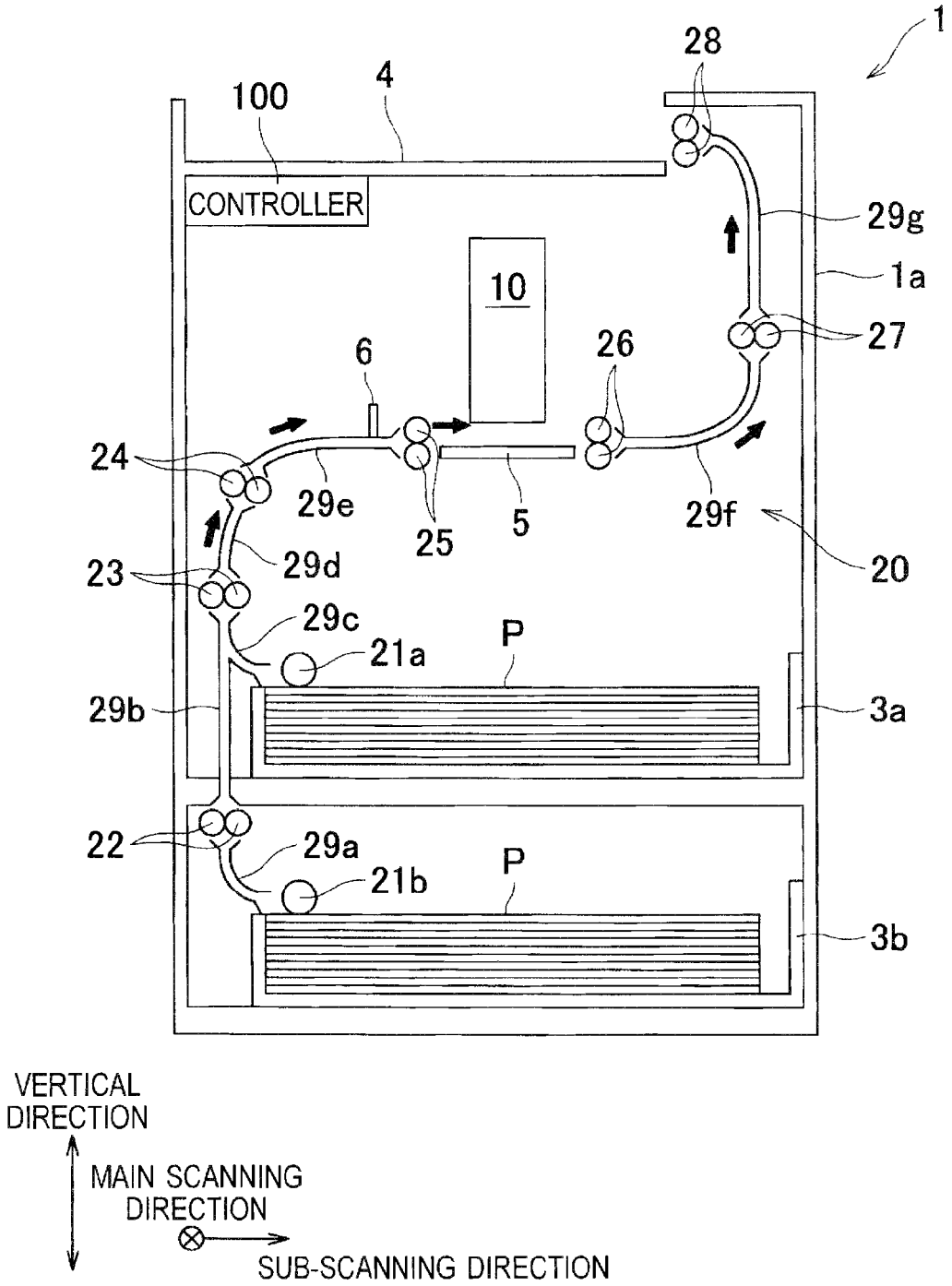
FIG. 1 is a schematic side view showing an inkjet printer according to a first embodiment.

As shown in FIG. 1, the printer 1 includes a casing 1*a*, an inkjet head 10, a platen 5, a paper sensor 6, a conveying device 20, accommodating devices 3*a* and 3*b*, a receiving section 4, and a controller 100. The head 10, the platen 5, the paper sensor 6, the conveying device 20, and the controller 100 are accommodated within the casing 1*a*. Each of the accommodating devices 3*a* and 3*b* is supported by the casing 1*a* so as to open and close, and is detachable in a main scanning direction relative to the casing 1*a*. The receiving section 4 is provided at an upper surface of a top plate of the casing 1*a*.

Figure 2:
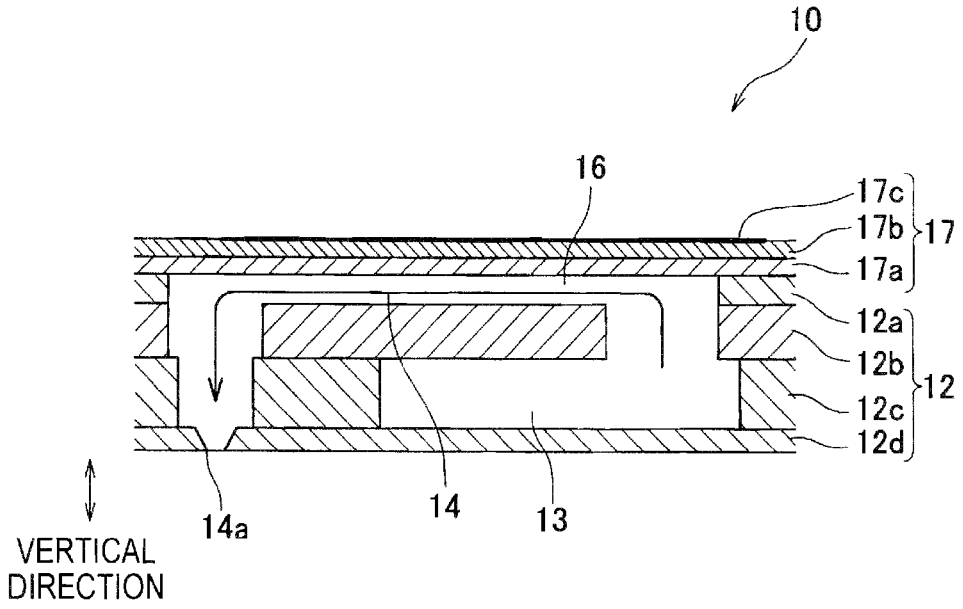
FIG. 2 is a partial cross-sectional view showing a head included in the printer of FIG. 1.

The head 10 is a line head having substantially a rectangular-parallelepiped shape elongated in the main scanning direction. As shown in FIG. 2, the head 10 includes a channel unit 12 and an actuator unit 17.

The channel unit 12 is a layered body in which four plates 12*a* to 12*d* are layered. The channel unit 12 has ink channels formed therein, and has a plurality of ejection ports 14*a* that opens in a lower surface thereof. The ink channels formed within the channel unit 12 include one manifold channel 13 and a plurality of individual channels 14. The individual channels 14 are provided for respective ones of the ejection ports 14*a*. Each individual channel 14 extends from the outlet of the manifold channel 13 to the ejection port 14*a* via a pressure chamber 16. The manifold channel 13 is in fluid communication with a tank (not shown) that stores ink. Ink supplied from the tank to the manifold channel 13 passes through the individual channel 14 and is ejected from the ejection port 14*a*.

The actuator unit 17 is a layered body in which a vibration plate 17*a*, a piezoelectric layer 17*b*, and a plurality of individual electrodes 17*c* are layered. The vibration plate 17*a* is fixed to the upper surface of the channel unit 12, and closes the plurality of pressure chambers 16. The piezoelectric layer 17*b* is fixed to the upper surface of the vibration plate 17*a*, and confronts the plurality of pressure chambers 16. The plurality of individual electrodes 17*c* is fixed to the upper surface of the piezoelectric layer 17*b*, and confronts respective ones of the plurality of pressure chambers 16. A portion of the actuator unit 17 sandwiched between each individual electrode 17*c* and the corresponding pressure chamber 16 functions as an individual unimorph-type actuator for each pressure chamber 16, and is deformable individually in response to voltage application to each individual electrode 17*c*. The actuator deforms to be convex toward the pressure chamber 16, which reduces the volume of the pressure chamber 16, applies pressure to ink within the pressure chamber 16, and causes ink to be ejected from the ejection port 14*a*. In this way, by selectively applying voltage to the plurality of individual electrodes 17*c*, the head 10 ejects ink selectively from the plurality of ejection ports 14*a*.

As shown in FIG. 1, the platen 5 is disposed below the head 10. A gap for recording is formed between the upper surface of the platen 5 and the lower surface of the head 10.

The conveying device 20 is configured to convey paper P from each of the accommodating devices 3*a* and 3*b* to the receiving section 4 via the gap between the head 10 and the platen 5. The conveying device 20 includes paper feeding rollers 21*a* and 21*b*, roller pairs 22 to 28, and guides 29*a* to 29*g*.

Figure 3:
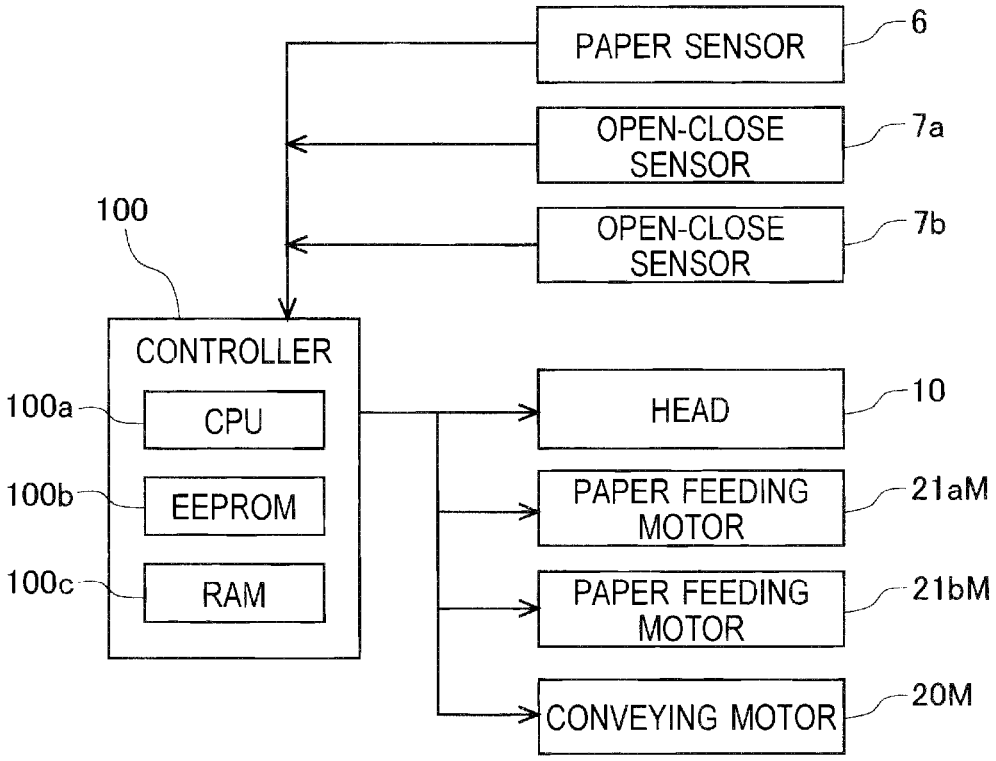
FIG. 3 is a block diagram showing an electrical configuration of the printer of FIG. 1.

The paper feeding rollers 21*a* and 21*b* are arranged at positions for making contact with the uppermost paper P in the accommodating devices 3*a* and 3*b*, respectively. The controller 100 controls paper feeding motors 21*a*M and 21*b*M (see FIG. 3) to drive the paper feeding rollers 21*a* and 21*b* to rotate, respectively. With this operation, the uppermost paper P in the accommodating device 3*a*, 3*b* is fed out of the accommodating device 3*a*, 3*b*.

Each of the roller pairs 22 to 28 includes two rollers in contact with each other, and is configured to convey paper P while nippingly holding the paper P with the two rollers. One of the two rollers included in each of the roller pairs 22 to 28 is a drive roller, and rotates by driving of a conveying motor 20M (see FIG. 3) controlled by the controller 100. The other of the two rollers included in each of the roller pairs 22 to 28 is a follow roller, and rotates in the opposite direction from the drive roller while being in contact with the drive roller due to rotation of the drive roller. Due to rotation of the roller pairs 22 to 28, paper P fed out of the accommodating devices 3*a* and 3*b* by the paper feeding rollers 21*a* and 21*b* passes below the head 10, and is conveyed toward the receiving section 4.

Each of the guides 29*a* to 29*g* is configured to define a conveying path of paper P, and includes a pair of plates that is arranged in a separated relationship with a gap therebetween.

The accommodating devices 3*a* and 3*b* are configured to accommodate a plurality of sheets of paper P, and to accommodate a plurality of sizes of paper P. The receiving section 4 is configured to receive a plurality of sheets of paper P, and to receive a plurality of sizes of paper P.

The paper sensor 6 is configured to output a signal indicative of whether paper P exists in the feeding path of paper P from the accommodating device 3*a*, 3*b* to the head 10 (specifically, at an upstream side of the head 10 on a conveying path (see thick arrows in FIG. 1) of paper P provided by the conveying device 20). The paper sensor 6 outputs an ON signal when paper P exists at this detection position, and outputs an OFF signal when paper P does not exist at the detection position.

The printer 1 is further provided with open-close sensors 7*a* and 7*b* (see FIG. 3) configured to output a signal indicative of whether the accommodating device 3*a*, 3*b* is open or closed, respectively. Each of the open-close sensors 7*a* and 7*b* outputs an ON signal when the accommodating device 3*a*, 3*b* is pulled out of the casing 1*a*, and outputs an OFF signal when the accommodating device 3*a*, 3*b* is mounted on the casing 1*a*.

The controller 100 includes a CPU (Central Processing Unit) 100*a* that is an arithmetic processing unit, an EEPROM (Electrically Erasable and Programmable Read Only Memory) 100*b*, a RAM (Random Access Memory) 100*c*, an ASIC (Application Specific Integrated Circuit), an I/F (Interface), an I/O (Input/Output Port), and so on. The EEPROM 100*b* stores programs executed by the CPU 100*a* and data needed for executing the programs in a rewritable manner. The RAM 100*c* temporarily stores data needed for executing the programs. The ASIC rewrites image data and rearrange image data (for example, signal processing and image processing). The I/F performs transmission and reception of data with an external apparatus (for example, a personal computer connected to the printer 1). The I/O performs input and output of detection signals of various sensors including the sensors 6, 7*a*, and 7*b*.

The printer 1 is configured to take a detectable state in which the open-close sensor 7*a* and 7*b* are supplied with electric power so that whether the accommodating device 3*a*, 3*b* is open or closed can be detected, and an undetectable state in which the open-close sensors 7*a* and 7*b* are not supplied with electric power so that whether the accommodating device 3*a*, 3*b* is open or closed cannot be detected. In the present embodiment, the undetectable state includes a power OFF state in which the power of the printer 1 is an OFF state, and a power saving mode state in which the amount of power consumption is smaller than in a normal mode. In the power OFF state and in the power saving mode state, electric power is not supplied to each part of the controller 100 and the sensors 6, 7*a*, and 7*b*. However, the EEPROM 100*b* keeps information without supplying of electric power (that is, in each of the power OFF state and the power saving mode state). In the present embodiment, the EEPROM 100*b* is used as an example of the memory.

Figure 4:
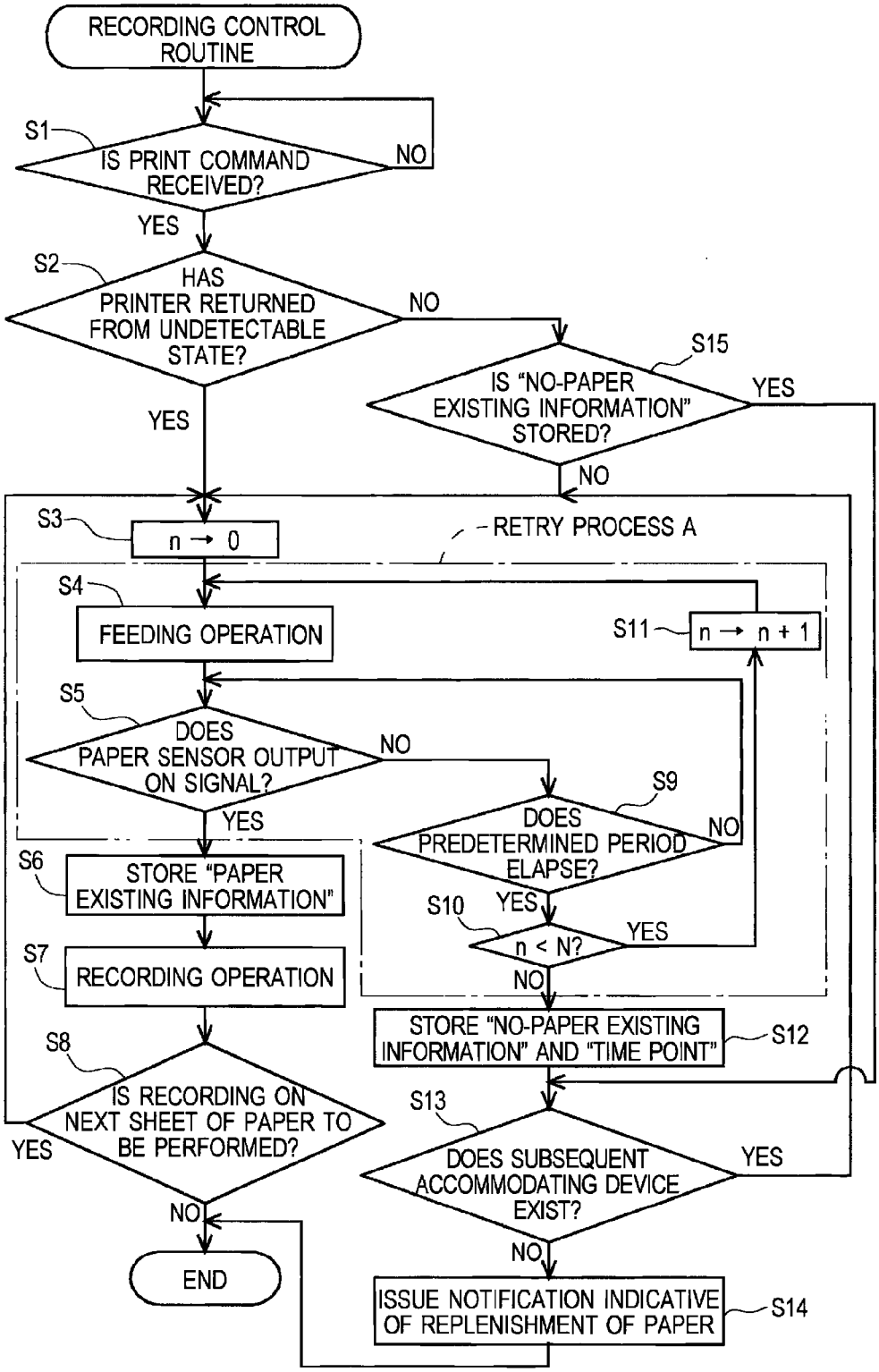
FIG. 4 is a flowchart showing a recording control routine executed by a controller of the printer of FIG. 1.
Figure 5:
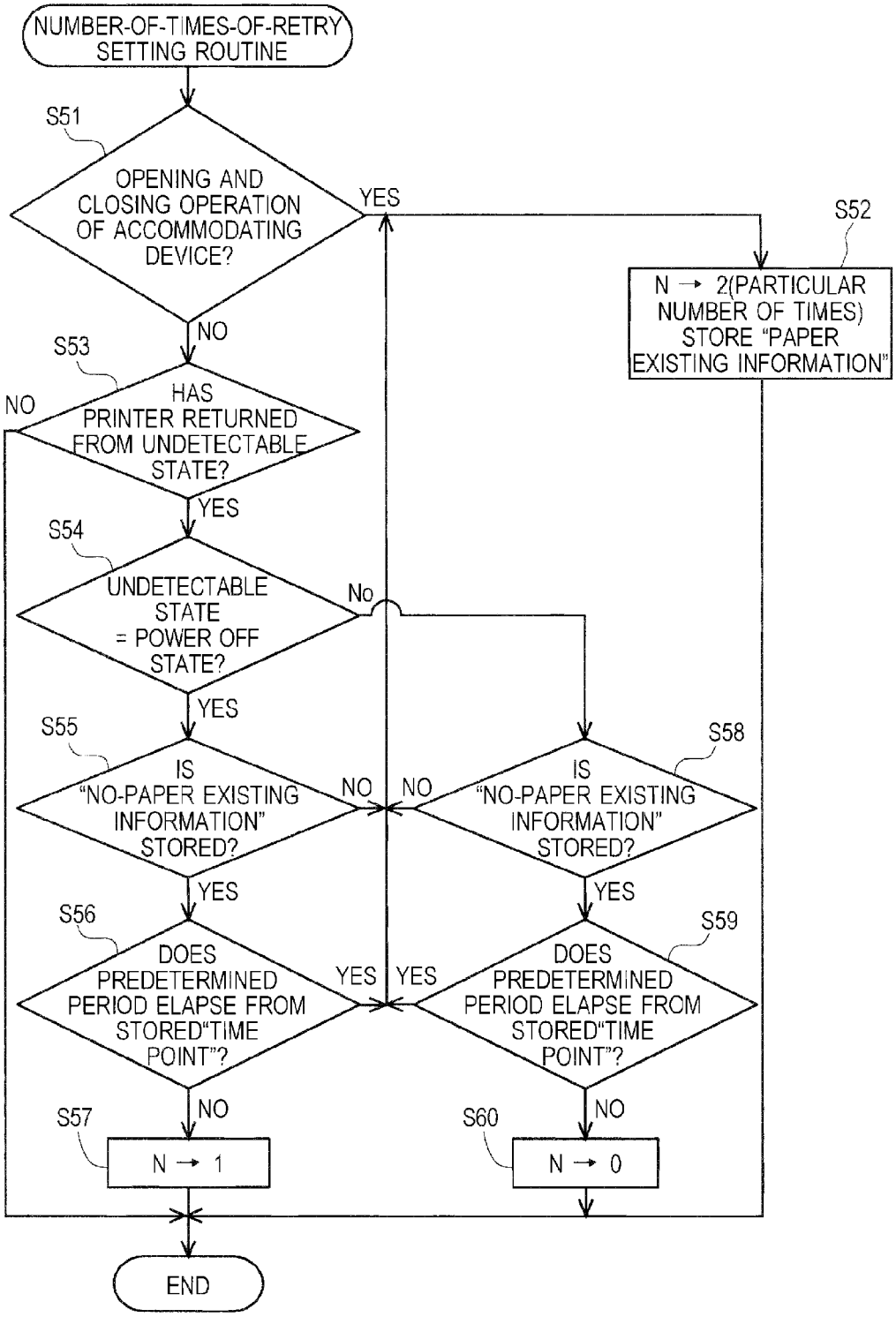
FIG. 5 is a flowchart showing a number-of-times-of-retry setting routine executed by the controller of the printer of FIG. 1.

Next, control processes executed by the controller 100 will be described while referring to FIGS. 4 and 5. While the power of the printer 1 is ON, the controller 100 executes a recording control routine shown in FIG. 4 and a number-of-times-of-retry setting routine shown in FIG. 5 in a parallel manner. The number-of-times-of-retry setting routine is executed for each of the accommodating devices 3*a* and 3*b*. Specifically, these routines are executed respectively at particular intervals.

In the recording control routine (see FIG. 4), first, the controller 100 determines whether a print command is received from an external apparatus (S1). If no print command is received (S1: NO), the controller 100 repeats the process of S1. If the print command is received (S1: YES), the controller 100 determines whether the printer 1 has returned from the undetectable state to the detectable state (S2).

If the printer 1 has returned from the undetectable state to the detectable state (S2: YES), the controller 100 initializes n ("n" is the number of times of retry) to "0" (S3). The "n" denotes the number of times of performing a retry process A described later. The retry process A is a process of repeating a paper feeding operation in response to failure of a paper feeding operation for one sheet of paper P.

After S3, the controller 100 controls the paper feeding motor 21*a*M or the paper feeding motor 21*b*M as well as the conveying motor 20M for a certain period so that the paper feeding operation is performed (S4). The paper feeding operation is an operation of supplying paper P in the accommodating device 3*a* or the accommodating device 3*b* to the head 10.

Note that the accommodating devices 3*a* and 3*b* are used in this order. That is, in this routine, the paper feeding operation from the accommodating device 3*a* is performed first and, after executing S13 described later, the paper feeding operation from the accommodating device 3*b* is performed. In the following descriptions, the accommodating device to perform a paper feeding operation is referred to as "subject accommodating device".

After S4, the controller 100 determines whether the paper sensor 6 outputs an ON signal (that is, paper P is fed out of the subject accommodating device and its leading end reaches a detection position of the paper sensor 6) (S5). If the paper sensor 6 outputs an ON signal (S5: YES), the controller 100 determines that the printer 1 succeeds in the paper feeding operation, and stores in the EEPROM 100*b* information indicating that paper P exists in the subject accommodating device (paper existing information) (S6).

After S6, the controller 100 drives the head 10 to perform a recording operation (S7). The recording operation is an operation of ejecting liquid onto paper P from the ejection ports 14*a* of the head 10. The paper P on which recording has been performed is received by the receiving section 4. After S7, the controller 100 refers to the received print command and determines whether to perform recording on the next sheet of paper P (S8). If recording on the next sheet of paper P is not to be performed (S8: NO), the controller 100 ends this routine. If recording on the next sheet of paper P is to be performed (S8: YES), the controller 100 returns the process to S3.

If the paper sensor 6 does not output an ON signal (S5: NO), the controller 100 determines whether a predetermined period elapses after starting the paper feeding operation (S4) (that is, after starting driving the paper feeding motor 21*a*M or the paper feeding motor 21*b*M and driving the conveying motor 20M) (S9). If the predetermined period does not elapse (S9: NO), the controller 100 returns the process to S5. If the predetermined period elapses (S9: YES), the controller 100 determines that the printer 1 fails in the paper feeding operation, and determines whether n is smaller than N (a setting value of the number of times of retry) for the subject accommodating device (S10). The value N is set in the number-of-times-of-retry setting routine (see FIG. 5).

If an inequality n<N is satisfied (S10: YES), the controller 100 adds "1" to n (S11). After S11, the controller 100 returns the process to S4 to again perform the paper feeding operation.

The series of processes of S4, S5, S9, S10, and S11 corresponds to the retry process A.

If an inequality n<N is not satisfied (S10: NO) (that is, if the printer 1 does not succeed in the paper feeding operation even after the retry process A is performed the set number of times of retry N), the controller 100 stores, in the EEPROM 100*b*, both information indicating that no paper P exists in the subject accommodating device (no-paper existing information) and a time point at which it is determined that the inequality n<N is not satisfied (that is, a time point at which it is determined that the printer 1 does not succeed in the paper feeding operation even after the retry process A is performed the number of times of retry N) (S12).

After S12, the controller 100 determines whether a subsequent accommodating device exists (S13). If the controller 100 performs the paper feeding operation from the accommodating device 3*a* in S4 the previous time, the controller 100 determines that a subsequent accommodating device exists (S13: YES), and returns the process to S3 and executes the processes for the accommodating device 3*b*. On the other hand, if the controller 100 performs the paper feeding operation from the accommodating device 3*b* in S4 the previous time, the controller 100 determines that no subsequent accommodating device exists (S13: NO), and controls an output device (a display, a speaker, and so on) of the printer 1 to issue a notification indicative of replenishment of paper P (S14). After S14, the controller 100 ends this routine.

If the printer 1 is not returned from the undetectable state (S2: NO) (that is, if the printer 1 does not go through the undetectable state), the controller 100 determines whether no-paper existing information is stored in the EEPROM 100*b* for the subject accommodating device (S15). If no-paper existing information is not stored (S15: NO), the controller 100 moves the process to S3 to perform the paper feeding operation from the subject accommodating device. On the other hand, if no-paper existing information is stored (S15: YES), the controller 100 moves the process to S13.

In the number-of-times-of-retry setting routine (see FIG. 5), the controller 100 first determines whether an opening and closing operation of the subject accommodating device is detected, based on a signal from a sensor corresponding to the subject accommodating device out of the open-close sensors 7*a* and 7*b* (S51). If an opening and closing operation of the subject accommodating device is detected (S51: YES), the controller 100 sets N to "2 (a particular number of times)" and stores "2" in the EEPROM 100*b* and also stores the paper existing information in the EEPROM 100*b* (S52). After S52, the controller 100 ends this routine.

If an opening and closing operation of the subject accommodating device is not detected (S51: NO), the controller 100 determines whether the printer 1 has returned from the undetectable state to the detectable state (S53). If the printer 1 has not returned from the undetectable state (S53: NO), the controller 100 ends this routine without rewriting N.

If the printer 1 has returned from the undetectable state to the detectable state (S53: YES), the controller 100 determines whether this undetectable state is a power OFF state (S54). If this undetectable state is a power OFF state (S54: YES), the controller 100 determines whether no-paper existing information for the subject accommodating device is stored in the EEPROM 100*b* (S55).

If no-paper existing information is not stored (S55: NO), the controller 100 determines that paper P exists in the subject accommodating device and moves the process to S52, and sets N to "2 (the particular number of times)" and stores "2" in the EEPROM 100*b*.

If no-paper existing information is stored (S55: YES), the controller 100 determines that no paper P exists in the subject accommodating device, and determines whether a predetermined period elapses from a time point stored in the EEPROM 100*b* (that is, a time point at which it is determined that the printer 1 does not succeed in the paper feeding operation even after the retry process A is performed a set number of times of retry N for the subject accommodating device) (S56).

If the predetermined period elapses (S56: YES), the controller 100 moves the process to S52 and sets N to "2 (particular number of times) and stores "2" in the EEPROM 100*b*, and also stores paper existing information in the EEPROM 100*b*. On the other hand, if predetermined period does not elapse (S56: NO), the controller 100 sets N to "1 (a number of times that is smaller than the particular number of times)" and stores "1" in the EEPROM 100*b* (S57). After S57, the controller 100 ends this routine.

If this undetectable state is not the power OFF state (S54: NO) (that is, the power saving mode state), the controller 100 determines whether no-paper existing information for the subject accommodating device is stored in the EEPROM 100*b* (S58).

If the no-paper existing information is not stored (S58: NO), the controller 100 determines that paper P exists in the subject accommodating device and moves the process to S52, and sets N to "2 (the particular number of times)" and stores "2" in the EEPROM 100*b*.

If the no-paper existing information is stored (S58: YES), the controller 100 determines that paper P does not exist in the subject accommodating device, and determines whether a predetermined period elapses from a time point stored in the EEPROM 100*b* (that is, a time point at which it is determined that the printer 1 does not succeed in the paper feeding operation even after the retry process A is performed the set number of times of retry N for the subject accommodating device) (S59).

If the predetermined period elapses (S59: YES), the controller 100 moves the process to S52 and sets N to "2 (the particular number of times)" and stores "2" in the EEPROM 100*b*, and also stores paper existing information in the EEPROM 100*b*. On the other hand, if the predetermined period does not elapse (S59: NO), the controller 100 sets N to "0 (the number of times that is smaller than the particular number of times and that is smaller than the number of times that the printer 1 is returned from the power OFF state) and stores "0" in the EEPROM 100*b* (S60). After S60, the controller 100 ends this routine.

As described above, according to the present embodiment, it is not that the controller 100 determines whether paper P exists in the accommodating device 3*a*, 3*b* based on a signal from the sensor provided at the accommodating device 3*a*, 3*b*, and performs the paper feeding operation after determining that paper P exists in the accommodating device 3*a*, 3*b*. Instead, if the printer 1 does not succeed in the paper feeding operation even after the retry process A (the process of repeating the paper feeding operation when the printer 1 fails in the paper feeding operation for one sheet of paper P; see FIG. 4) is performed the set number of times of retry N (S10: NO), the controller 100 stores, in the EEPROM 100*b*, information indicating that no paper P exists in the accommodating device 3*a*, 3*b* (S12). If the printer 1 succeeds in the paper feeding operation (S5: YES), the controller 100 stores, in the EEPROM 100*b*, information indicating that paper P exists in the accommodating device 3*a*, 3*b* (S6). With this process, it is possible to save a time period for determination based on the signal from the sensor provided at the accommodating device 3*a*, 3*b*, and hence throughput can be improved.

Further, the printer 1 takes the detectable state and the undetectable state. In the undetectable state, it cannot be detected whether the accommodating device 3*a*, 3*b* is open or closed. Thus, it is conceivable that in the undetectable state the user replenishes the accommodating device 3*a*, 3*b* with paper P. In this case, the recording control routine shown in FIG. 4 is not executed and information in the EEPROM 100*b* is not rewritten. Therefore, the information in the EEPROM 100*b* and the actual existence or non-existence of paper in the accommodating device 3*a*, 3*b* may be different. Hence, if the printer 1 has returned from the undetectable state to the detectable state, it is conceivable to uniformly set the number of times of retry N to a particular number of times (the number of times that is set before the printer 1 becomes the undetectable state) regardless of information in the memory. In this case, however, the retry process A is performed the particular number of times even if there is a high possibility that no paper P exists in the accommodating device 3*a*, 3*b*, which requires a longer time period and leads to deterioration of throughput. Thus, in the present embodiment, when the printer 1 has returned from the undetectable state to the detectable state (S53: YES), the controller 100 does not uniformly set the number of times of retry N to "2 (particular number of times)", but sets the number of times of retry N based on the existence of paper P in the accommodating device 3*a*, 3*b*. Specifically, the controller 100 determines whether paper P exists in the accommodating device 3*a*, 3*b* based on the information stored in the EEPROM 100*b* (S55 and S58, "first determining process"). If it is determined that paper P exists in the accommodating device 3*a*, 3*b* (S55: NO, S58: NO), the number of times of retry N is set to "2 (the particular number of times)" (S52). If it is determined that no paper P exists in the accommodating device 3*a*, 3*b* (S55: YES, S58: YES), the number of times of retry N is set to "1 or 0 (the number of times that is smaller than the particular number of times)" (S57, S60). With this operation, a time period required for the paper feeding operation can be reduced, and throughput can be improved.

The information stored in the EEPROM 100*b* and indicative of whether paper P exists in the accommodating device 3*a*, 3*b* is based on the signal outputted from the paper sensor 6 (see S5, S6, and so on). The paper sensor 6 can also be used for controlling recording timing. Hence, according to the above-described configuration, there is no need to separately provide a sensor for detecting whether paper P exists and a sensor used for controlling recording timing, which reduces the number of parts.

If the paper sensor 6 does not output a signal indicating that paper P exists (S5: NO), within a predetermined period since the paper feeding operation is started (S9: YES), the controller 100 determines that the printer 1 fails in the paper feeding operation. If the paper sensor 6 outputs a signal indicating that paper P exists (S5: YES), within the predetermined period since the paper feeding operation is started (S9: NO), the controller 100 determines that the printer 1 succeeds in the paper feeding operation. According to this configuration, failure or success of the paper feeding operation can be determined appropriately by using the paper sensor 6.

If it is determined in S55, S58 (the first determining process) that no paper P exists in the accommodating device 3*a*, 3*b* (S55: YES, S58: YES), the controller 100 determines whether a predetermined period elapses since a time point stored in the EEPROM 100*b* (S56, S59; the second determining process). If it is determined that the predetermined period elapses (S56: YES, S59: YES), the number of times of retry N is set to "2 (the particular number of times)" (S52). If it is determined that the predetermined period does not elapse (S56: NO, S59: NO), the number of times of retry N is set to "1 or 0 (the number of times that is smaller than the particular number of times)" (S57, S60). As time elapses, a possibility increases that the user replenishes the accommodating device 3*a*, 3*b* with paper P. The above-described configuration considers this trend. If there is a high possibility that paper P exists in the accommodating device 3*a*, 3*b* (if the predetermined period elapses), the number of times of retry N is set to the particular number of times. On the other hands, if there is a high possibility that no paper P exists in the accommodating device 3*a*, 3*b* (if the predetermined period does not elapse), the number of times of retry N is set to a smaller number. With this process, both of improvement of throughput and appropriate paper feeding operation can be realized.

The undetectable state includes a power OFF state in which the power of the printer 1 is in an OFF state. The memory is a non-volatile memory (the EEPROM 100*b*). Since the memory is a non-volatile memory, information in the memory is kept even in the power OFF state. Thus, according to the above-described configuration, even when the printer 1 has returned from the power OFF state, effects of the embodiment can be obtained reliably.

The undetectable state further includes a power saving mode state in which the amount of power consumption is smaller than in the normal mode. If it is determined that no paper P exists in the accommodating device 3*a*, 3*b* after the printer 1 returns from the power saving mode state, the controller 100 sets the number of times of retry N to a number of times that is smaller than a case where it is determined that no paper P exists in the accommodating device 3*a*, 3*b* after the printer 1 returns from the power OFF state (see S57, S60). It is conceived that the power saving mode state is kept for a shorter period than the power OFF state. If the time period is shorter, a possibility is low that the user replenishes the accommodating device 3*a*, 3*b* with paper P. The above-described configuration considers this trend. If there is a high possibility that no paper P exists in the accommodating device 3*a*, 3*b* (if the printer 1 returns from the power saving mode state), the number of times of retry N is set to a number of times that is smaller than a case where a possibility is relatively low that no paper P exists in in the accommodating device 3*a*, 3*b* (a case where the printer 1 returns from the power OFF state). Thus, throughput can be further improved.

The printer 1 of the present embodiment includes the two accommodating devices 3*a* and 3*b*. If the printer 1 does not succeed in the paper feeding operation even after the retry process A is performed the set number of times of retry N for the accommodating device 3*a* (S10: NO), the controller 100 stores, in the EEPROM 100*b*, information indicating that no paper P exists in the accommodating device 3*a* (S12), and subsequently performs the paper feeding operation for the accommodating device 3*b* (S4). In a configuration where a plurality of accommodating devices is provided, if the number of times of retry N is uniformly set to a particular number of times in a case where the printer 1 returns from the undetectable state, throughput deteriorates significantly. According to the above-described configuration, throughput can be improved more reliably.

If the printer 1 does not go through the undetectable state (S2: NO) and if it is determined that no paper P exists in the accommodating device 3*a*, 3*b* based on information stored in the EEPROM 100*b* (S15: YES), the controller 100 performs an outputting process of outputting a signal indicating that the accommodating device 3*a*, 3*b* is to be replenished with paper P, without performing the paper feeding operation (S14). If the printer 1 does not go through the undetectable state, information in the memory (the EEPROM 100*b*) is highly reliable. Hence, if the EEPROM 100*b* stores information indicating that no paper P exists, the outputting process of outputting a signal is performed without performing the paper feeding operation, which saves a time period required for the paper feeding operation and improves throughput as a whole.

If an opening and closing operation of the accommodating device is detected (S51: YES), the controller 100 stores, in the EEPROM 100*b*, information indicating that paper P exists in the accommodating device 3*a*, 3*b* (S52). If the accommodating device 3*a*, 3*b* is opened or closed, it is assumed that there is a high possibility that the user replenishes the accommodating device 3*a*, 3*b* with paper P. The above-described configuration considers this trend. Compared with a case where information indicating that no paper P exists remains to be stored in the EEPROM 100*b* regardless of a fact that the accommodating device 3*a*, 3*b* is opened or closed, reliability of the information in the memory (the EEPROM 100*b*) can be improved.

Next, an inkjet printer according to a second embodiment will be described, wherein like parts and components are designated by the same reference numerals to avoid duplicating description.

The printer according to the second embodiment has the same configuration as the printer 1 of the first embodiment, except that the RAM 100*c* is used as the memory instead of the EEPROM 100*b*, and that the undetectable state includes a power OFF state and a particular power saving mode state in which the amount of power consumption is smaller than in the normal mode while maintaining power supply to the memory (the RAM 100*c*). In the particular power saving mode state, although power supply to each part of the controller 100 is maintained, the sensors 6, 7*a*, and 7*b* are not supplied with electric power. In the present embodiment, the controller 100 executes a control process that "EEPROM 100*b*" is replaced with "RAM 100*c*" in the control process of the first embodiment.

Although the memory is a volatile memory, in the particular power saving mode in which power supply to the memory (the RAM 100*c*) is maintained as described above, information in the memory is kept. Thus, according to the second embodiment, in addition to similar effects due to the same configuration as that of the first embodiment, the effects can be obtained reliably when the printer 1 returns from the particular power saving mode state.

While the invention has been described in detail with reference to the above aspects thereof, it would be apparent to those skilled in the art that various changes and modifications may be made therein without departing from the scope of the claims.

For example, the number of the accommodating devices may be an arbitrary number that is larger than or equal to one.

The accommodating device may be undetachable relative to the casing, as long as the accommodating device is supported by the casing so as to open and close.

Further, the accommodating device need not be accommodated within the casing, and may be disposed outside the casing as a manual-feed tray is.

The direction in which the accommodating device moves relative to the casing at the time of opening and closing may be an arbitrary direction.

The memory is not limited to an EEPROM or a RAM, and may be an arbitrary memory.

In the above-described embodiment, the programs executed by the CPU 100*a* and the number of times of retry are stored in the same memory (EEPROM 100*b*). However, the programs executed by the CPU 100*a* and the number of times of retry may be stored in different memories.

The particular number of times of the number of times of retry is not limited to "2", and may be an arbitrary number.

The controller need not perform the second determining process. For example, if it is determined in the first determining process that no recording medium exists in the accommodating device, the controller may set the number of times of retry to a number of times that is smaller than the particular number of times, without performing the second determining process.

The controller need not store, in the memory, a time point at which it is determined that the printer does not succeed in the feeding operation even after the retry process is performed a set number of times of retry.

In the above-described embodiment, the setting value of the number of times of retry is different between a case where the recording apparatus returns from the power OFF state and a case where the recording apparatus returns from the power saving mode state. However, the setting value of the number of times of retry may be the same between the both cases.

The recording device is not limited to an inkjet printer, and may be a laser printer, a thermal printer, and so on.

The number of the recording devices may be an arbitrary number, that is, the number is not limited to one, and may be a plural number.

The invention is not limited to a line type, but may be applied to a serial type.

The invention is not limited to a printer, but may be applied to a facsimile apparatus, a copier, and so on.

The recording medium is not limited to recording paper, but may be an arbitrary medium on which recording can be performed.

What is claimed is:

1. A recording apparatus comprising:

a casing;

a recording device provided in the casing and configured to perform recording on a recording medium;

an accommodating device supported by the casing and configured to open and close relative to the casing, the accommodating device being configured to accommodate the recording medium;

an open-close sensor configured to output a signal indicative of whether the accommodating device is open or closed;

a feeder configured to perform a feeding operation of feeding the recording medium in the accommodating device to the recording device;

a processor; and a memory configured to store instructions and to store information indicative of whether a recording medium exists in the accommodating device, the information including first information indicating that no recording medium exists in the accommodating device and second information indicating that a recording medium exists in the accommodating device, wherein the recording apparatus is configured to take: a detectable state in which the open-close sensor is supplied with electric power so as to enable detection of whether the accommodating device is open or closed; and an undetectable state in which the open-close sensor is not supplied with electric power so as to disable detection of whether the accommodating device is open or closed; and wherein, when executed by the processor, the instructions cause the processor to:

in response to failure in the feeding operation of one recording medium, perform a retry process of controlling the feeder to again perform the feeding operation;

in response to not succeeding in the feeding operation even after the retry process is performed a set number of times of retry, store the first information in the memory;

in response to succeeding in the feeding operation, store the second information in the memory; and in response to returning from the undetectable state to the detectable state, perform a first determining process of determining whether a recording medium exists in the accommodating device based on one of the first information and the second information.

2. The recording apparatus according to claim 1, wherein, when executed by the processor, the instructions cause the processor to:

in response to determining in the first determining process that a recording medium exists in the accommodating device, set the number of times of retry to a particular number of times; and in response to determining in the first determining process that no recording medium exists in the accommodating device, set the number of times of retry to a number of times that is smaller than the particular number of times.

3. The recording apparatus according to claim 2, wherein the processor is configured to:

in response to not succeeding in the feeding operation even after the retry process is performed the number of times of retry, store, in the memory, both of the first information and a time point of determining that the feeding operation does not succeed;

in response to determining the first determining process that no recording medium exists in the accommodating device, perform a second determining process of determining whether a second time period elapses from the time point stored in the memory;

in response to determining in the second determining process that the second time period elapses, set the number of times of retry to the particular number of times; and in response to determining in the second determining process that the second time period does not elapse, set the number of times of retry to a number of times smaller than the particular number of times.

4. The recording apparatus according to claim 1, further comprising a medium sensor configured to output a signal indicative of whether a recording medium exists in a feeding path of the recording medium, the feeding path being defined from the accommodating device to the recording device, wherein the first information and the second information are based on the signal outputted from the medium sensor.

5. The recording apparatus according to claim 4, wherein the processor is configured to determine that the feeding operation fails in a case where the medium sensor does not output the signal within a first time period after the feeding operation is started; and wherein the processor is configured to determine that the feeding operation succeeds in a case where the medium sensor outputs the signal within the first time period.

6. The recording apparatus according to claim 1, wherein the undetectable state includes a power OFF state in which a power of the recording apparatus is OFF; and wherein the memory is a non-volatile memory.

7. The recording apparatus according to claim 6, wherein the undetectable state further includes a power saving mode state in which an amount of power consumption is smaller than an amount of power consumption in a normal mode; and in response to determining that no recording medium exists in the accommodating device after the recording apparatus returns from the power OFF mode state, the processor is configured to set the number of times of retry to a first number of times; and in response to determining that no recording medium exists in the accommodating device after the recording apparatus returns from the power saving mode state, the processor is configured to set the number of times of retry to a second number of times that is smaller than the first number of times.

8. The recording apparatus according to claim 1, wherein the undetectable state includes a particular power saving mode state in which power supply to the memory is maintained and an amount of power consumption is smaller than an amount of power consumption in a normal mode; and wherein the memory is a volatile memory.

9. The recording apparatus according to claim 1, wherein the accommodating device comprises a plurality of accommodating devices including a first accommodating device and a second accommodating device different from the first accommodating device;

wherein the open-close sensor comprises a plurality of open-close sensors provided for respective ones of the plurality of accommodating devices;

wherein the feeder is configured to perform the feeding operation for the respective ones of the plurality of accommodating devices;

wherein the memory is configured to store either one of the first information and the second information for the respective ones of the plurality of accommodating devices; and wherein, in response to not succeeding in the feeding operation even after the retry process is performed the number of times of retry for the first accommodating device, the processor is configured to store the first information in the memory, and subsequently to control the feeder to perform the feeding operation for the second accommodating device.

10. The recording apparatus according to claim 9, wherein, in response to determining that no subsequent accommodating device exists, the processor is configured to output a signal for replenishing a recording medium.

11. The recording apparatus according to claim 1, wherein, in response to determining that no recording medium exists in the accommodating device in a case where the recording apparatus does not go through the undetectable state, the processor is configured to output a signal for replenishing a recording medium in the accommodating device without performing the feeding operation.

12. The recording apparatus according to claim 1, wherein, in response to detecting an opening and closing operation of the accommodating device based on the signal outputted from the open-close sensor, the processor is configured to store the second information in the memory.

13. The recording apparatus according to claim 1, further comprising a medium sensor configured to output a signal indicative of whether a recording medium exists in a feeding path of the recording medium, the feeding path being defined from the accommodating device to the recording device, wherein the first information is stored when the signal is not outputted from the medium sensor; and wherein the second information is stored when the signal is outputted from the medium sensor.

* * * * *